United States Patent [19]

Brito

[11] Patent Number: 4,754,613

[45] Date of Patent: Jul. 5, 1988

[54] VACUUM PROCESS FOR PHYSICAL DEODORIZATION AND/OR PHYSICAL REFINING OILS AND FATS THROUGH DIRECT CONDENSATION OF THE VAPORS

[75] Inventor: Luiz A. L. Brito, Sao Paulo, Brazil

[73] Assignee: Sanbra-Sociedade Algodoeira do Nordeste Brasileiro S.A., Brazil

[21] Appl. No.: 841,254

[22] Filed: Mar. 19, 1986

[30] Foreign Application Priority Data

Sep. 23, 1985 [BR] Brazil ..... 85 04651

[51] Int. Cl.[4] ..... F25B 19/00

[52] U.S. Cl. ..... 62/100; 55/55; 62/532; 260/424; 260/428.5

[58] Field of Search ..... 62/532, 541, 434, 20, 62/54, 100; 260/420, 428, 428.5, 424, 425, 426; 202/182.5; 203/42; 55/55

[56] References Cited

U.S. PATENT DOCUMENTS

| | | | |
|---|---|---|---|
| 2,352,883 | 7/1944 | Bolley | 62/532 |
| 2,944,072 | 7/1960 | Vaccarino et al. | 260/426 |
| 3,239,547 | 3/1966 | Brion et al. | 202/185.2 |
| 3,249,517 | 5/1966 | Lockman | 202/185.2 |
| 3,649,657 | 3/1972 | Staker et al. | 260/420 X |
| 3,779,030 | 12/1973 | Best | 62/541 |
| 3,943,155 | 3/1976 | Young | 260/424 |
| 3,965,085 | 6/1976 | Holmbom et al. | 260/428.5 X |
| 4,188,290 | 2/1980 | Graham et al. | 260/428.5 |
| 4,228,089 | 10/1980 | Bischof et al. | 62/532 X |
| 4,314,455 | 2/1982 | Engdahl | 62/532 |

FOREIGN PATENT DOCUMENTS

| | | | |
|---|---|---|---|
| 878779 | 11/1981 | U.S.S.R. | 260/424 |

*Primary Examiner*—Steven E. Warner

*Attorney, Agent, or Firm*—Ostrolenk, Faber, Gerb & Soffen

[57] ABSTRACT

An improved vacuum process is disclosed for use in treating vapors created during deodorization and/or physical refining of edible oils and fats. Vapors are condensed by contact with a saline solution which may be introduced at a temperature below the freezing point of pure water, the temperature being adjusted according to desired absolute pressure. Saline solution is recirculated through a flotation and cooling unit where a constant addition of salt and a purge of solution are made.

7 Claims, 1 Drawing Sheet

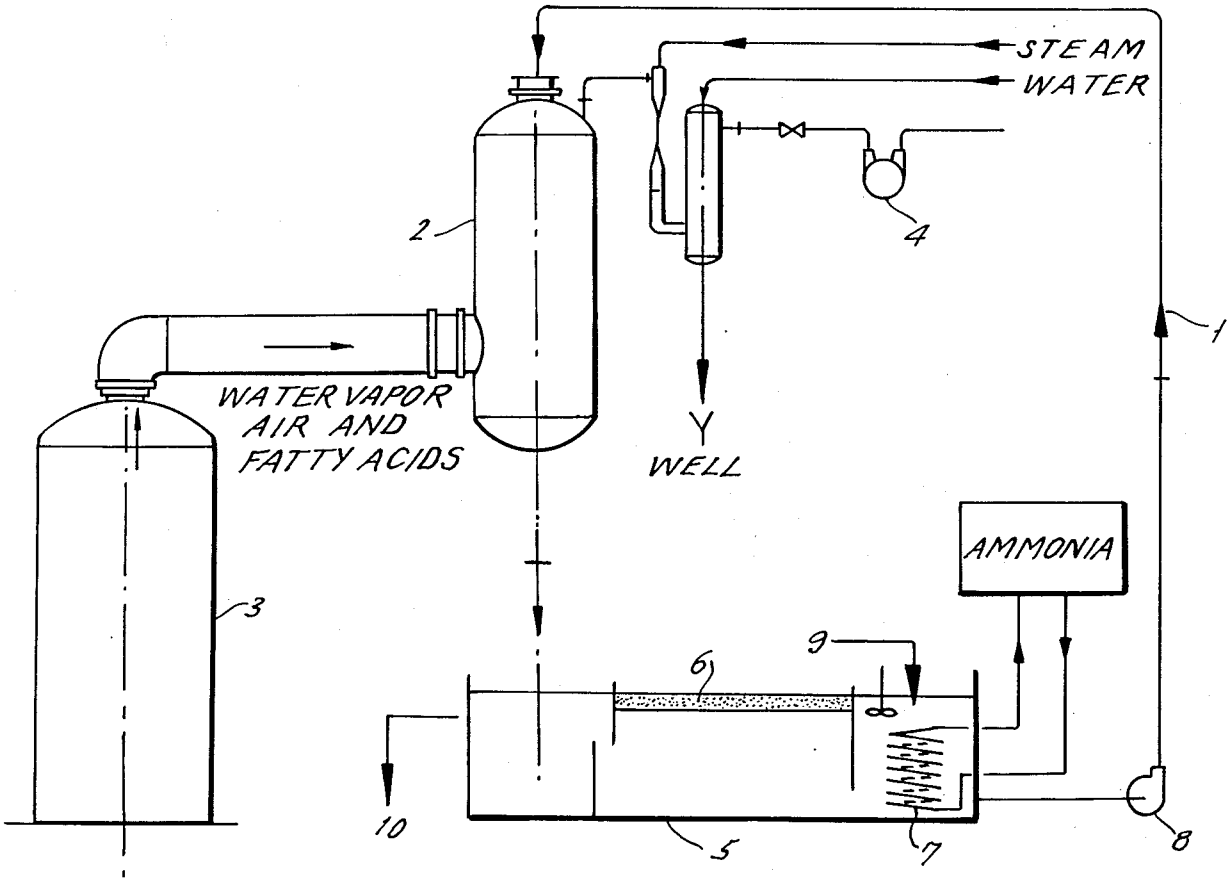
STEAM
WATER
WELL
WATER VAPOR
AIR AND
FATTY ACIDS
AMMONIA
1
2
3
4
5
6
7
8
9
10

VACUUM PROCESS FOR PHYSICAL DEODORIZATION AND/OR PHYSICAL REFINING OILS AND FATS THROUGH DIRECT CONDENSATION OF THE VAPORS

BACKGROUND OF THE INVENTION

As it is generally known already, both in the physical deodorization and refining of edible oils and fats, those products are submitted to an extremely rarified environment (2 through 6 mmHg) for a given time and temperature. During this period, water vapor is injected in the system in order to reduce further the partial pressure of the volatile oil/fat components in the inner atmosphere of the refining equipment. In order that an extremely low absolute pressure can be maintained even with injection of direct steam, the industrial equipment is provided with a vacuum system. The function that system is to continuously remove this vapor and other gases (air and volatiles) so as to maintain the inner atmosphere operating at low absolute pressure.

For the above purpose, as widely practiced in the industry, a set of steam ejectors with intermediate condensation is employed. These are well used with or without coupling to liquid ring vacuum pumps. In those systems, the gases which are basically composed of water vapor, air and volatiles, are initially compressed from the operating pressure of the equipment (2 through 6 mmHg) to a higher pressure (typically 30 through 50 mmHg), at which the water can be condensed at usual temperatures. The equipment employed for this compression is a steam ejector, wherein the kinetic energy of the motive steam drags and increases the internal pressure by mixing with vaporous gases to be treated. Depending on the rate of compression required, one, two or three stages of compression are employed. The output flow of the first ejector still is a mixture of gases, mostly water vapor, at a somewhat higher absolute pressure (30 through 50 mmHg). At this pressure, water can be condensed at the usual temperatures. This is done in direct contact condensers employing cooling water. After most of the water vapor has condensed, the incondensables still saturated with water vapor are pumped again up to atmospheric pressure.

Depending on economic considerations, the pressurization is done employing ejector sets with or without intermediate condensation, vacuum pumps or a combination of both. For the first compression stage (from 2–6 mmHg to 30–50), mechanical compressors are not employed due to the high flows involved.

It should be noted further that the ejector that performs the first compression is the part of the apparatus involving most of the steam consumption in the process of refining edible oils/fats. From the energy use viewpoint, the known equipment is extremely inefficient, since it requires a quantity of motive steam two to five times greater than that of the steam dragged. This inefficiency is aggravated where the temperature of the water available for subsequent condensation is high and, accordingly, also the pressure of that water.

The table below, published in the Journal of American Oil Chemists Society", Nr. 2, vol. 62, page 314, of February 1985, illustrates quite accurately the influence of steam water temperature:

| | | | | |
|---|---|---|---|---|
| SUCTION LOAD: | vapour | 102 kg/hr. | Vacuum: | 2.5 mmHg |
| | air | 10 kg/hr. | vapor | 3 bar g |

-continued

| | | pressure: |
|---|---|---|
| Cooling water temp. | 26° C. | 16° C. |
| Cooling water flow | 76 cu.m./hr. | 47 cu.m./hr. |
| Vapour consumption | 630 kg/hr. | 360 kg/hr. |
| Electr. power cons. | 17 kW | 12 kW |

Another important problem, which is associated with deodorization and particularly with the vacuum system employed for deodorizing, is the resulting environmental pollution, both hydric and atmospheric, which results from the high cooling water flows involved. This water is continuously contaminated with organic substances at a very low concentration. The direct treatment of the liquid effluent has a practically prohibitive cost in view of its high volume.

A partial solution normally employed by refineries is to recirculate this water in cooling towers, which causes an eventual and undesirable generation of odors.

Even though this matter has been widely dealt with in recent publications and at congresses in this specific area, there is still no optimim solution for the problem. The solutions heretofore proposed have questionable efficiency or they are handicapped by higher energy consumptions as compared to the invention. An example of a previous solution is to employ indirect heat exchangers to cool the water in the direct contact condensers, for preventing the delivery of organic substance-contaminated water to the cooling tower. The problem or the inconvenience of odor generation is solved, since the contaminated water is recirculated in a closed circuit. However, the temperature of the water is somewhat higher, and a higher differential would be present in the heat exchange in the indirect exchangers. In a warm weather climate, where the water temperature already warrants exceptionally high steam consumption, the above solution is practically unfeasible or results in too high operational costs.

SUMMARY OF THE INVENTION

The operational process of the invention works under direct condensation conditions at low temperature. Essentially, it consists of condensing most of the water vapor at the normal operating pressure of the physical deodorization or refining equipment. This way, the suction load to be compressed up to atmospheric pressure is practically negligible, and consists basically of incondensables and only the water vapor saturation quantity.

In order that condensation will occur at the low absolute pressures involved, it is necessary to employ temperatures below the pure water freezing point. This renders the utilization of surface condensers inadequate since, besides needing a large heat exchange surface, the deposition of ice and organic material on the exchange surface requires shutdowns, cleaning changes and other inconvenience.

DESCRIPTION OF THE DRAWING

The drawing schematically illustrates a circuit in which the process of the invention is performed.

DESCRIPTION OF THE PREFERRED EMBODIMENT

As can be seen on the illustration of the appended schematic circuit, the improved process employs a sodium chloride solution which passes along a conduit (1)

at a 15–24% concentration to serve as the condensing medium and which enters a direct contact condenser (2). The condensed water vapor incorporates itself in the solution. The sodium chloride solution is an appropriate condensing medium, as its freezing point is much lower than the temperatures required to attain vapor pressures equivalent to the operational pressures required. The presence of a solute, sodium chloride, affects the process by causing a slight lowering of the water vapor pressure in the solution, in relation to pure water.

The vapors arising out of physical deodorization or refining (3) are basically comprised of water vapor and small quantities of organic substances and incondensables. These vapors pass through the direct contact barometric condenser (2) where they enter in intimate contact with the previously cited sodium chloride solution. Prior to that contact, the solution is at a temperature of 5 to 15 negative degrees centigrade.

Most of the water vapor condenses, incorporating itself into the flow of solution and transferring its heat of condensation to the solution. The incondensables, jointly with the saturation vapor, are then removed from the top of the condenser (2) and are transferred to and compressed through ejectors and/or vacuum pumps (4). The great improvement is that the flow of gases to be compressed is now on the order of 10 to 20 times smaller.

The sodium chloride solution, with added water from condenser (2) is now at a temperature 3° to 10° C. higher than that of the sodium chloride solution at the inlet. The solution goes by gravity to flotating-cooling equipment (5) which is specially developed for this purpose. Here the organic matter (6) which also condenses at this temperature, is separated by flotation. Subsequently, the already purified solution is cooled by evaporation of a refrigerant fluid passing inside cooling coils (7) immersed in the solution. The solution is thereby returned to the condenser inlet temperature (5 to 15 negative degrees centigrade). A centrifugal pump (8) continuously returns the solution to the condenser (2).

As the solution is constantly being diluted by the addition of condensing water, the perodic addition of sodium chloride (9) and removal of some solution are necessary, in order to maintain the total volume and concentration.

The concentrated sodium chloride solution which must be constantly removed comprises a small flow (on the order of 200 to 300 kg/hr. for the usual deodorizers) which has a low organic load. Accordingly, it can be easily treated if required. In most cases, it is possible to employ this solution in other processes, such as, for example, the manufacture of soaps (10) or the treatment of the refining sludge itself.

When the above described process is compared with the internationally accepted industrial practice of employing high capacity steam ejectors, the following technical-economical advantages clearly result:

(a) decrease in the total energy consumption;

(b) Complete elimination of atmospheric pollution;

(c) greater stability of the absolute pressure.

The above benefits are better explained and also justified for the following reasons:

(a) decrease in total energy consumption

The exact amount of the total energy consumption is a function of the specific conditions of each project and installation, and particularly of the operating pressure employed in the physical deodorization/refining equipment and the temperature of the cooling water available on the site.

From the energy viewpoint, in the present case, equipment (a steam booster ejector) which is being replaced, in order to compress a water vapor flow, consumes a motive steam quantity 3 to 6 times greater than that which is to be compressed. The replacement mechanical cooling system consumes as electrical power a fraction of the thermal energy transported. In terms of equivalent energy, the decrease in electric power consumption is 10 to 15% of the steam consumption in terms of equivalent energy. This ratio makes the improved process substantially more advantageous in respect of electric and thermal power costs.

With the processing system of the invention, it is possible to attain steam consumptions of 50 to 55 kg/t of deodorized oil in the deodorization of edible oils and fats, where the usual values for current industrial equipment range from 170 to 400 kg/t. It should be noted further that the corresponding increase in electric power is of the order of 12 to 20 kWhr./ton.

(b) complete elimination of atmospheric pollution

The processing system of the invention is completely hermetic, since the sodium chloride solution which is recirculated and contacts the organic substances does not openly contact the environment.

The gases composed or air and incondensables which are constantly removed from the facility are conveyed through piping to the thermal fluid boiler annexed to the physical deodorization or refining facility. The organic substances being eliminated by combustion. Those gases are less contaminated as compared with those in usual installations, since they had submitted to an aqueous washing at a temperature of 5 to 15 negative decrees centigrade.

The cooling tower, which conventionally operated with contaminated water and was a source for the generation of odors, was replaced by another tower that has 5 to 10 times less capacity in terms of thermal load and that operates with clean water which circulates in the refrigerating system condensers without having any contact with organic matter.

(c) more stability of the absolute pressure

The absolute pressure in the deodorization and refining of edible oils and fats is a critical process variable. If oscillations in the pressure should occur during the process and if they reach higher values, even for a small period of time, the quality of the end product will be adversely affected.

In the usual vacuum systems with steam ejectors, due to the system dynamic characteristics, any sudden oscillation in the motive steam pressure or in the load of vapor to be compressed has an immediate effect upon the absolute pressure, with the disadvantages arising therefrom. A sudden increase in the load of vapor to be compressed is frequently caused, for example, by admission jointly with the product to be deodorized/refined, of small quantities of water which, in the process evaporate instantly. In the process of the invention, a thermal flywheel is created by the volume of circulating brine, which is on the order of 15 to 20 tons, and this absorbs a large portion of those variations, thereby resulting in a very stable absolute pressure, which are not subject to transient oscillations.

I claim:

1. A vacuum process for treating refinement vapors created during processing of edible oils and fats, said process comprising contacting said vapors in a contact vessel with an amount of a saline solution effective to condense water vapor present in said refinement vapors, wherein said saline solution is injected at a temperature between about −15° C. and about 0° C.

2. The process according to claim 1, wherein said saline solution has a sodium chloride concentration between about 0% and about 10% by weight and has a saturation point at a temperature from about −15° C. to about −5° C.

3. The process according to claim 1, wherein at least about 80% of the steam present in said vapors is condensed.

4. The process according to claim 1, wherein said contacting occurs without substantially increasing the pressure in said contact vessel beyond that maintained during said processing.

5. The process according to claim 1, further comprising the steps of collecting said saline solution, after contacting with said vapors, cooling said collected saline solution, and recirculating said cooled solution for re-use in said contact vessel.

6. The process according to claim 5, wherein said saline solution follows a pathway which is hermetically sealed.

7. The process according to claim 5, wherein organic materials are separated and removed from said collected saline solution by flotation.

* * * * *